United States Patent [19]

Feis

[11] 4,059,129

[45] Nov. 22, 1977

[54] CYLINDRICAL BODY PROVIDED WITH MEANS FOR COUNTERACTING VIBRATIONS RESULTING FROM A TRANSVERSELY FLOWING FLUID

[75] Inventor: Nikolaas Feis, Apeldoorn, Netherlands

[73] Assignee: Nederlandsche Organisatie Voor Toegepast-Natuurwetenschappelijk Onderzoek Ten Behoeve Van Nijverheid, The Hague, Netherlands

[21] Appl. No.: 655,829

[22] Filed: Feb. 6, 1976

[30] Foreign Application Priority Data

Feb. 18, 1975 Netherlands ..... 7501866

[51] Int. Cl.[2] ..... F15D 1/00

[52] U.S. Cl. ..... 138/37; 138/39; 138/40; 138/44; 138/177; 138/178

[58] Field of Search ..... 138/26, 27, 178, 177, 138/28, 38, 37, 39

[56] References Cited

U.S. PATENT DOCUMENTS

| | | | |
|---|---|---|---|
| 2,726,681 | 12/1955 | Gaddis et al. | 138/38 |
| 2,930,405 | 3/1960 | Welsh | 138/38 |
| 3,006,377 | 10/1961 | Hanprecht et al. | 138/37 |
| 3,086,395 | 4/1963 | York | 138/37 X |
| 3,088,494 | 5/1963 | Koch et al. | 138/37 |
| 3,200,848 | 8/1965 | Takagi | 138/38 |

*Primary Examiner*—Henry K. Artis
*Attorney, Agent, or Firm*—Hammond & Littell

[57] ABSTRACT

Cylindrical body the outer periphery of which is provided with means to counteract vibrations occurring in that body as a result from transverse flow against it, these means comprising a number of small planes mounted according to a certain pattern and placed substantially perpendicular to the outer periphery of the body, which planes form an angle of from 5° to 25° with the cross-section of this cylindrical body; the surfaces of these planes at the most amounting to 2.5% of the surface of the cross-section of the cylindrical body and their lengths at most to 20% of the diameter of this body.

8 Claims, 7 Drawing Figures

CYLINDRICAL BODY PROVIDED WITH MEANS FOR COUNTERACTING VIBRATIONS RESULTING FROM A TRANSVERSELY FLOWING FLUID

BACKGROUND OF THE INVENTION

The invention relates to a cylindrical body that at the outer periphery is provided with means for counteracting vibrations occurring in that body, both in the direction of flow and perpendicular to it, which result from a transverse flow against it.

The invention is in particular of importance for application in constructing bunches of tubes in heat exchangers, pipe lines in rivers, piers of oil rigs, suspension cables or pillars of bridges, chimneys and the like.

In such bodies vibrations are caused by periodically simultaneously or, alternatingly to the left and to the right of the cylindrical body, shedding of vortices that are carried along with the flow and which are formed each time simultaneously or alternately at either side of this body and behind it.

If the frequency of shedding of these so-called von Karman vortices corresponds with the own frequency for bending vibrations of the cylindrical body, as a result of amplification such great amplitudes may arise, that by fatigue or overloading breakage will occur in this cylindrical body.

Violent vibrations will occur if shedding of vortices over greater lengths of the cylindrical body will occur simultaneously, so that great resulting oscillating bending moments affect this body.

It has been proposed in the art to reduce the vibrations in chimneys, pipe constructions and the like occurring as a result of transverse flow, by application of long helical ribs at the periphery of such pipe constructions.

These helical ribs, however, form a great angle with the cross-section of these pipe constructions and the application of these ribs will increase the average resistance of a cylindrical body to a considerable extent.

In case of overcritical conditions of flow it will be possible that this resistance even increases by a factor of from 2 to 3.

SUMMARY OF THE INVENTION

Now it is the object of the invention to provide means for the prevention of a coordinated shedding of vortices over a greater length of a cylindrical body and for the prevention of the resulting aforesaid vibrations of this body, without any considerable increase in the resistance, thus in case of undercritical conditions of flow enabling the achievement of an important reduction in resistance.

According to the invention these means comprise a number of planes, which are mounted according to a certain pattern and are substantially perpendicular to the outer periphery of the cylindrical body, and which form an angle of from 5° to 25° with the cross-section of this cylindrical body.

Preferably, the surfaces of these substantially vertical planes will amount to 2.5% at the most of the surface of the cross-section of the cylindrical body and their lengths at the most to 20% of the diameter of the cylindrical body.

DESCRIPTION OF THE PREFERRED EMBODIMENTS

Figure 1:
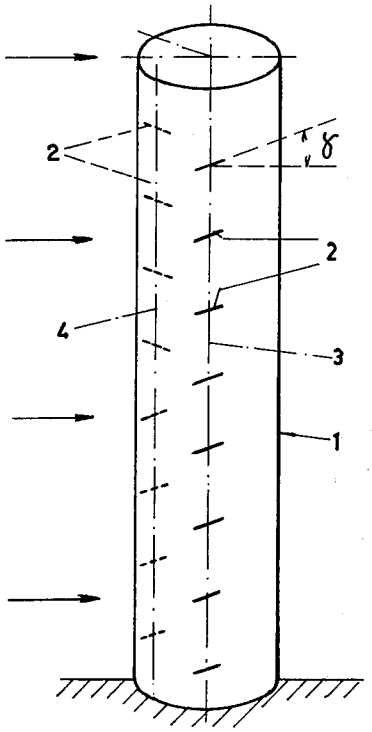
FIG. 1, is a profile view of a cylindrical body showing the vertical plane.

In FIG. 1 a number of substantially vertical planes 2 are mounted on to the outer periphery of a cylindrical body 1, against which a fluid flows transversely in the direction of the arrows drawn.

These planes 2 are placed along the describing lines 3 and 4, which seen from the forward thrust line of the arrows lie under an angle $\alpha$ of 90° to the right and under an angle $\beta$ of 30° to the left with respect to the plane of symmetry in the direction of flow as projected through the axis of the cylindrical body.

Figure 2:
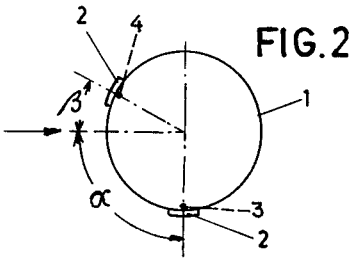
FIG. 2 is a cross-sectional view of FIG. 1.

In FIG. 2, which shows a cross-section of the cylindrical body, these angles $\alpha$ and $\beta$ as well as the location of two vertical planes 2 are shown.

The vertical planes according to describing line 3 are unidirected and the vertical planes according to describing line 4 are placed in groups either in the same direction as or in the direction opposite to the planes according to describing line 3.

Planes 2 indicated in FIG. 1 form an angle $\gamma$ of 25° with the cross-section of cylindrical body 1.

Instead of, as drawn in FIG. 2, the asymmetrical position of describing lines 3 and 4 in respect of the direction of flow, these describing lines can also lie symmetrical in respect of the direction of flow (thrust line) under angles between 30° and 90°.

The vertical planes hereinafter to be called "vortex generators" can consist of more or less sheet-like elements and will preferably be constructed streamline-shaped in cross-section.

Figure 4:
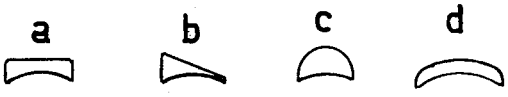
FIG. 4*a* is a cross-sectional view of a vertical plane.
FIG. 4*b* is a cross-sectional view of another embodiment of a vertical plane.
FIG. 4*c* is a cross-sectional view of another embodiment of a vertical plane.
FIG. 4*d* is a cross-sectional view of still another embodiment of a vertical plane.

In terms of planform they may be rectangular, but may also have other planforms as triangular, semi-circular, ellipsoid etc. such as in FIG. 4 is shown under embodiments *a* to *d* inclusive.

Because these vortex generators form a small angle $\gamma$ lying between 5° and 25° with the cross-section of the cylindrical body, the fluid is flowing against them under that angle and they act as wings with a small aspect ratio (ratio wing surface to average chord or length of the planes) behind which strong screw vortices are formed.

These screw vortices that are formed at the upstream side of the cylinder flow past the cylinder surface to the back and prevent that the shedding of the "von Karman" vortices at the wake side of the cylinder will take place coordinatedly over greater lengths.

In order to obtain an interruption of the "von Karman" vortices in a way as advantageous as possible, i.e. the reduction desired of vibrations at an average resistance as low as possible, the vortex generators are mounted according to a specific pattern.

It may be posed that in the cylindrical body according to the invention the location of the vortex generators can be rather arbitrarily, with a certain degree of occupation per unit of length of the cylindrical body being retained, but from the production point of view mostly regular patterns are applied.

As regards the mutual distances between the vortex generators, these distances, seen in the longitudinal direction of the cylindrical body, will, preferably, amount to not less than 0.5 and not more than twice the diameter of this cylindrical body.

The pattern to be chosen will further depend on various factors, such as the direction of flow (permanent or variable), the nature of the flow (laminar or turbulent), the Reynold number of the flow (under-, over- or transcritical), the correct shape of the cylindrical section of the body, the nature of the vibrations to be suppressed (in the direction of flow or perpendicular to it) and the possibility of vibration damping in the cylindrical body itself.

The location of the vortex generators indicated in FIG. 1 in this connection yields an embodiment that, preferably, is applied in case of a permanent (constant) direction of flow against the cylindrical body.

When the direction of flow is permanent, according to the invention the vortex generators are preferably located according to describing lines at the upstream side of the cylindrical body, which lines seen from the forward thrust line lie in an area between 30° and 90° to the left and to the right of the plane of symmetry in the direction of flow through the axis of the cylindrical body.

Furthermore, the vortex generators can be mounted to the left and to the right at equal height and all stand directed either upward or downward with an angle of inclination of from 5° to 25°.

They can also stand on the left-hand and right-hand describing lines not at equal heights, but, for instance, shifted over half their mutual distance and be directed differently per describing line or in groups on a describing line (see FIG. 1).

A favourable arrangement is, furthermore, that in which the vortex generators are alternately directed upward and downward on the same describing line, so that the screw vortices formed at the same side of the cylinder surface will alternately rotate in opposite directions.

When the flow against the cylinder surface is variable, such as, for instance, in case of chimneys, by the wind according to the invention the vortex generators will preferably be placed according to describing lines in the form of a number of helices with a pitch angle between 5° and 15°.

Then to the way of location and direction of the vortex generators apply, furthermore, the same rules as has been stated above at the location according to vertical describing lines.

Figure 3:
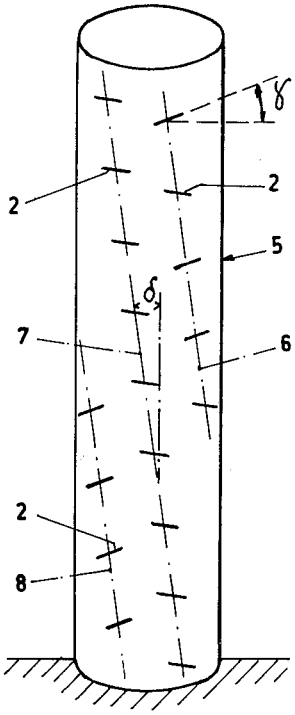
FIG. 3 is another embodiment of the invention.

FIG. 3 gives an embodiment for the set-up of vortex generators on a cylindrical body that is subjected to a variable flow of a fluid against it.

On the periphery of a cylindrical body 5 vortex generators 2 are mounted according to three helices 6, 7 and 8 with a pitch angle $\delta$ of 15°.

The vortex generators placed according to helix 6, here alternately have opposite directions and the vortex generators according to helix 7 have opposite angles of inclination in respect of those of the vortex generators according to helix 8.

Finally, it can be observed that for the suppression of vibrations of chimneys and the like it is not always necessary to mount the vortex generators over the entire length of a chimney, but that it has been found that it may be sufficient to apply them over, for instance, one-third of the length.

I claim:

1. A cylindrical body that at the outer periphery is provided with means for counteracting vibrations of said body resulting from a transverse flow against the outside of said body, wherein said means comprise a plurality of small planes which extend on substantially a perpendicular direction from the outer surface of said cylindrical body and which form an angle of 5°–25° with a cross-section of said cylindrical body which is perpendicular to the axis of said body and have a greater length than width which are mounted substantially perpendicular to the outer surface of said cylindrical body.

2. A cylindrical body according to claim 1, wherein the surface of the vertical planes at the most amounts to 2.5% of the surface of the cross-section of the cylindrical body and their length at the most to 20% of the diameter of the cylindrical body.

3. A cylindrical body according to claim 1, wherein the vertical planes are constructed streamline-shaped in cross-section.

4. A cylindrical body according to claim 1, wherein the mutual distances between the vertical planes seen in the longitudinal direction of the cylindrical body amount to not less than 0.5 and to not more than twice the diameter of this body.

5. A cylindrical body according to claim 1, wherein the vertical planes are located according to describing lines, which at the upstream side between 30° and 90° lie to the left and to the right of the plane of symmetry in the direction of flow through the axis of the cylindrical body.

6. A cylindrical body according to claim 1 wherein the vertical planes are located according to describing lines in the form of a number of helices with pitch angles of from 5° to 15°.

7. A cylindrical body according to claim 6, wherein the vertical planes on the one describing line or helix have pitch angles that are directed either in the same direction as or in the direction opposite to the vertical planes on the other describing line or helix.

8. A cylindrical body according to claim 1, wherein the vertical planes on each of the describing lines per plane or per group alternately have opposite pitch angles.

* * * * *